US009079400B2

(12) United States Patent
Kusunoki et al.

(10) Patent No.: US 9,079,400 B2
(45) Date of Patent: Jul. 14, 2015

(54) INK JET HEAD

(71) Applicant: TOSHIBA TEC KABUSHIKI KAISHA, Tokyo (JP)

(72) Inventors: Ryutaro Kusunoki, Shizuoka (JP); Chiaki Tanuma, Tokyo (JP); Shuhei Yokoyama, Shizuoka (JP); Ryuichi Arai, Shizuoka (JP)

(73) Assignee: Toshiba Tec Kabushiki Kaisha, Tokyo (JP)

( * ) Notice: Subject to any disclaimer, the term of this patent is extended or adjusted under 35 U.S.C. 154(b) by 0 days.

(21) Appl. No.: 14/024,029

(22) Filed: Sep. 11, 2013

(65) Prior Publication Data

US 2014/0071204 A1 Mar. 13, 2014

(30) Foreign Application Priority Data

Sep. 11, 2012 (JP) ..... 2012-199847

(51) Int. Cl.
*B41J 2/14* (2006.01)
*B41J 2/16* (2006.01)

(52) U.S. Cl.
CPC .... *B41J 2/14233* (2013.01); *B41J 2002/14241* (2013.01); *B41J 2002/14475* (2013.01); *B41J 2202/15* (2013.01)

(58) Field of Classification Search
CPC ..... B41J 2/14072; B41J 2/26; B41J 2002/14491; B41J 2002/14459
USPC ..... 347/50
See application file for complete search history.

(56) References Cited

U.S. PATENT DOCUMENTS

| | | | | | |
|---|---|---|---|---|---|
| 5,828,394 | A * | 10/1998 | Khuri-Yakub et al. | ..... | 347/72 |
| 6,354,695 | B1 * | 3/2002 | Kim et al. | ..... | 347/48 |
| 7,334,335 | B2 * | 2/2008 | Shin et al. | ..... | 29/890.1 |
| 7,378,030 | B2 * | 5/2008 | Truninger et al. | ..... | 216/27 |
| 7,600,856 | B2 * | 10/2009 | Lebens et al. | ..... | 347/56 |
| 2002/0008733 | A1 * | 1/2002 | Lee et al. | ..... | 347/48 |
| 2005/0219338 | A1 * | 10/2005 | Kusakari | ..... | 347/87 |

FOREIGN PATENT DOCUMENTS

| | | | |
|---|---|---|---|
| JP | 61-215059 | A | 9/1986 |
| JP | H3-065350 | A | 3/1991 |
| JP | 10-058672 | A | 3/1998 |
| JP | 10058672 | A * | 3/1998 |
| JP | 2009-088685 | A | 4/2009 |
| JP | 2009088685 | A * | 4/2009 |
| JP | 2011-056939 | A | 3/2011 |

OTHER PUBLICATIONS

Pending U.S. Appl. No. 13/864,535, filed Apr. 17, 2013.
Japanese Office Action, Patent Application No. JP 2012-199847, dated Apr. 8, 2014.

* cited by examiner

*Primary Examiner* — Matthew Luu
*Assistant Examiner* — Patrick King
(74) *Attorney, Agent, or Firm* — Patterson & Sheridan, LLP

(57) ABSTRACT

According to one embodiment, an ink jet head includes an ink pressure chamber, a nozzle hole, a vibrating plate, an actuator, and electrodes. The ink pressure chamber stores ink which is discharged through the nozzle hole. The vibrating plate is formed to surround the nozzle hole. The actuator drives the vibrating plate. The electrodes are formed to be axially symmetrical with respect to the nozzle hole and drive the actuator.

9 Claims, 8 Drawing Sheets

INK JET HEAD

CROSS-REFERENCE TO RELATED APPLICATION

This application is based upon and claims the benefit of priority from Japanese Patent Application No. 2012-199847, filed Sep. 11, 2012, the entire contents of which are incorporated herein by reference.

FIELD

Exemplary embodiments described herein relate generally to an ink jet head.

BACKGROUND

As an on demand-type ink jet recording method in which ink droplets are discharged from nozzles according to an image signal to form an image on recording paper by the ink droplets, there is a piezoelectric element type. A piezoelectric element-type ink jet head discharges ink stored in an ink chamber from nozzles using deformation of piezoelectric elements. The piezoelectric element is an element that converts a voltage applied thereto into movement. When an electric field is exerted on the piezoelectric element, elongation or shear deformation occurs. Due to the deformation of the piezoelectric element, a change in the size of the chamber to which the piezoelectric element is coupled causes the ink to be discharged from the nozzles. In order to enhance printing quality, the piezoelectric element needs to be reliably deformed to stabilize the discharge direction of the ink.

DETAILED DESCRIPTION

Exemplary embodiments described herein provide an ink jet head having good printing quality.

In general, according to one embodiment, an ink jet head includes: an ink pressure chamber; a nozzle hole; a vibrating plate; an actuator; and electrodes. The ink pressure chamber stores ink which is discharged through the nozzle hole. The vibrating plate is formed to surround the nozzle hole. The actuator drives the vibrating plate. The electrodes are formed to be axially symmetrical with respect to the nozzle hole and drive the actuator.

Hereinafter, exemplary embodiments will be described in detail.

First, the entire configuration of an ink jet head according to the exemplary embodiments will be described.

Figure 1:
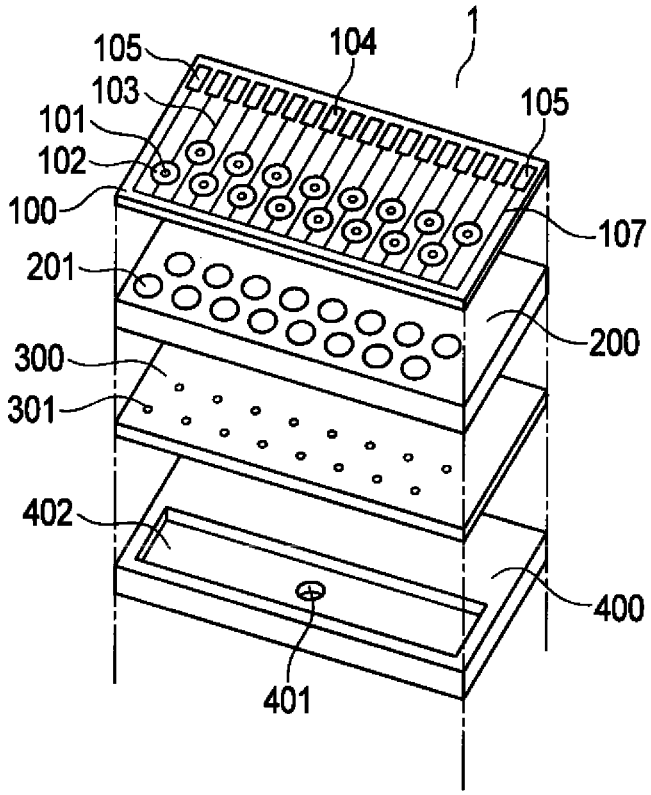
FIG. 1 is an exploded perspective view of a first configuration example of an ink jet head according to an embodiment.

FIG. 1 is an exploded perspective view of an ink jet head 1 of a first configuration example.

The ink jet head 1 of the first configuration example illustrated in FIG. 1 is constituted by a nozzle plate 100, an ink pressure chamber structure 200, a separate plate 300, an ink supply path structure 400, and the like.

The nozzle plate 100 has a plurality of nozzle holes 101 (ink discharge holes) for discharging ink, which penetrate through the nozzle plate 100 in the thickness direction thereof.

The ink pressure chamber structure 200 has a plurality of ink pressure chambers 201 corresponding to the plurality of nozzle holes 101. The ink pressure chambers 201 and the nozzle holes 101 are provided one on one, and each of the ink pressure chambers 201 is connected to the corresponding nozzle hole 101.

The separate plate 300 has ink throttles 301 (openings for supplying ink to the ink pressure chambers) connected to the ink pressure chambers 201 formed in the ink pressure chamber structure 200. The ink throttles 301 are provided to correspond to the plurality of nozzle holes 101 and the ink pressure chambers 201. The plurality of ink pressure chambers 201 are connected to an ink supply path 402 through the respective ink throttles 301.

The ink pressure chamber 201 holds ink for image formation. The ink in the ink pressure chamber 201 is discharged from each of the nozzle holes 101 by a change in pressure in each of the ink pressure chambers 201 generated due to the deformation of the nozzle plate 100. When the ink is discharged, the separate plate 300 traps the pressure generated in the ink pressure chamber 201 and carries out a role of preventing the pressure from escaping to the ink supply path 402. Therefore, the diameter of the ink throttle 301 is, for example, equal to or smaller than ¼ of the diameter of the ink pressure chamber 201.

The ink supply path 402 is in the ink supply path structure 400. In the ink supply path structure 400, an ink supply port 401 for supplying ink from the outside of the ink jet head is provided. The ink supply path 402 extends beyond the physical location of the plurality of ink pressure chambers 201 to enable simultaneous supply of the ink to all the ink pressure chambers 201.

For example, the ink pressure chamber structure 200 is made of a silicon wafer having a thickness of 725 μm. Each of the ink pressure chambers 201 is formed in a cylindrical shape having a diameter of 240 μm. The nozzle hole 101 is provided at the center of the circle of each of the ink pressure chambers 201.

In addition, the separate plate 300 is, for example, made of a stainless steel having a thickness of 200 μm, and the diameter of the ink throttles 301 extending therethrough may be about 100 μm. The ink throttles 301 are formed to suppress variations in the shape of the ink throttles 301 so that the resistances in ink flow paths to the respective ink pressure chambers 201 are substantially the same.

The ink supply path structure 400 is, for example, made of a stainless steel having a thickness of 4 mm, and the ink supply path 402 may be formed as a reservoir having a depth extending about 2 mm from the surface of the stainless steel from which the structure 400 is configured. The ink supply port 401 is disposed substantially at the center of the ink supply path 402. The ink supply port 401 is configured and arranged to cause the resistances in the ink flow paths of the respective ink pressure chambers 201 to be substantially the same.

In addition, the nozzle plate 100 has an integrated structure formed on the ink pressure chamber structure 200 by a film forming process described later.

The ink pressure chamber structure 200, the separate plate 300, the ink supply path structure 400 are joined by an epoxy adhesive to cause the nozzle holes 101 and the ink pressure chambers 201 to maintain a predetermined positional relationship with respect to one another.

For example, the ink pressure chamber structure 200 is formed from a silicon wafer, and the separate plate 300 and the ink supply path structure 400 are formed from a stainless steel. However, the materials of the structures 200, 300, and 400 are not limited to the silicon wafer and the stainless steel. The structures 200, 300, and 400 can also be formed from other materials in consideration of differences in the coefficient of expansion of the nozzle plate 100 as far as the other materials do not affect the generation of the ink discharge pressure. For example, as for the materials of the structures 200, 300, and 400, ceramic materials such as nitrides or oxides, for example, alumina ceramics, zirconia, silicon carbide, silicon nitride, and barium titanate can be used, and resin materials such as plastic materials, for example, ABS (acrylonitrile butadiene styrene), polyacetal, polyamide, polycarbonate, and polyethersulfone can also be used. In addition, metallic materials (alloys) can also be used as the materials of the structures 200, 300, and 400, and materials such as aluminum and titanium can be employed as representative materials.

Figure 2:
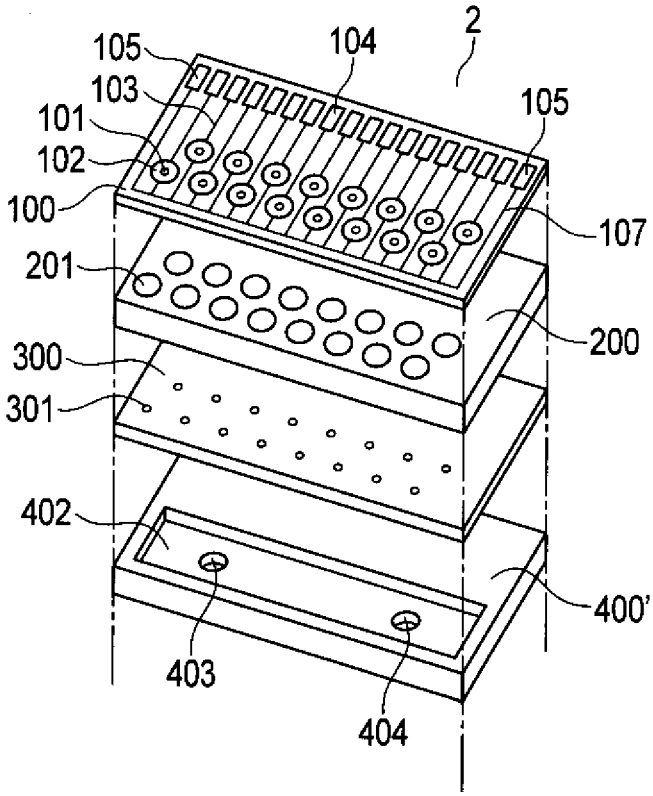
FIG. 2 is an exploded perspective view of a second configuration example of the ink jet head according to the embodiment.

FIG. 2 is an exploded perspective view of an ink jet head 2 of a second configuration example.

The second configuration example illustrated in FIG. 2 is different from the first configuration example illustrated in FIG. 1 in that the second configuration example has a configuration in which the ink may be circulated in the ink supply path 402. The second configuration example illustrated in FIG. 2 has a configuration in which a circulation ink supply port 403 and a circulation ink discharge port 404 are disposed adjacent the opposed ends of the ink supply path 402. In addition, the ink jet head 2 of the second configuration example illustrated in FIG. 2 may have the same configuration as the ink jet head 1 of the first configuration example except for the configuration by which the ink is circulated.

In the ink jet head 2 of the second configuration example illustrated in FIG. 2, the temperature of the ink in the ink supply path 402 can be easily maintained at a constant level by circulating the ink. Therefore, according to the ink jet head of the second configuration example illustrated in FIG. 2, there is an effect of suppressing a temperature increase in the ink jet head caused by heat generated due to the deformation of the nozzle plate 100 and the like by circulation of the ink.

In addition, as described above, the ink jet head 1 of the first configuration example and the ink jet head 2 of the second configuration example use the nozzle plate and actuators in common and thus can be made at low cost.

Next, the configuration of the nozzle plate 100 will be described.

Configuration Examples of the nozzle plate 100 (100A, 100B, 100C) described below can be applied to any of the ink jet head 1 of the first configuration example and the ink jet head 2 of the second configuration example.

Figure 3A:
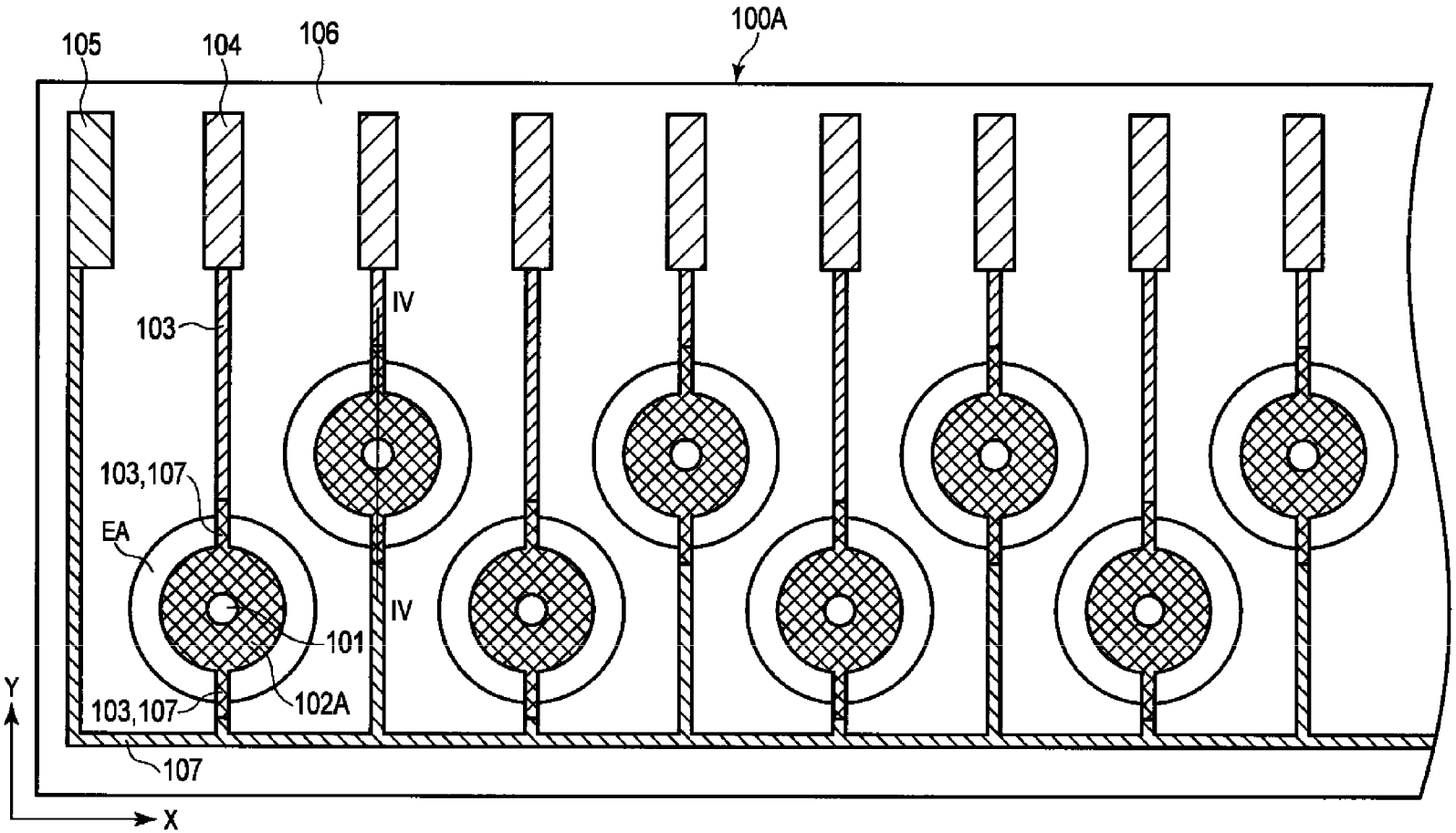
FIG. 3A is a plan view illustrating a first configuration example of a nozzle plate according to the embodiment.
Figure 4:
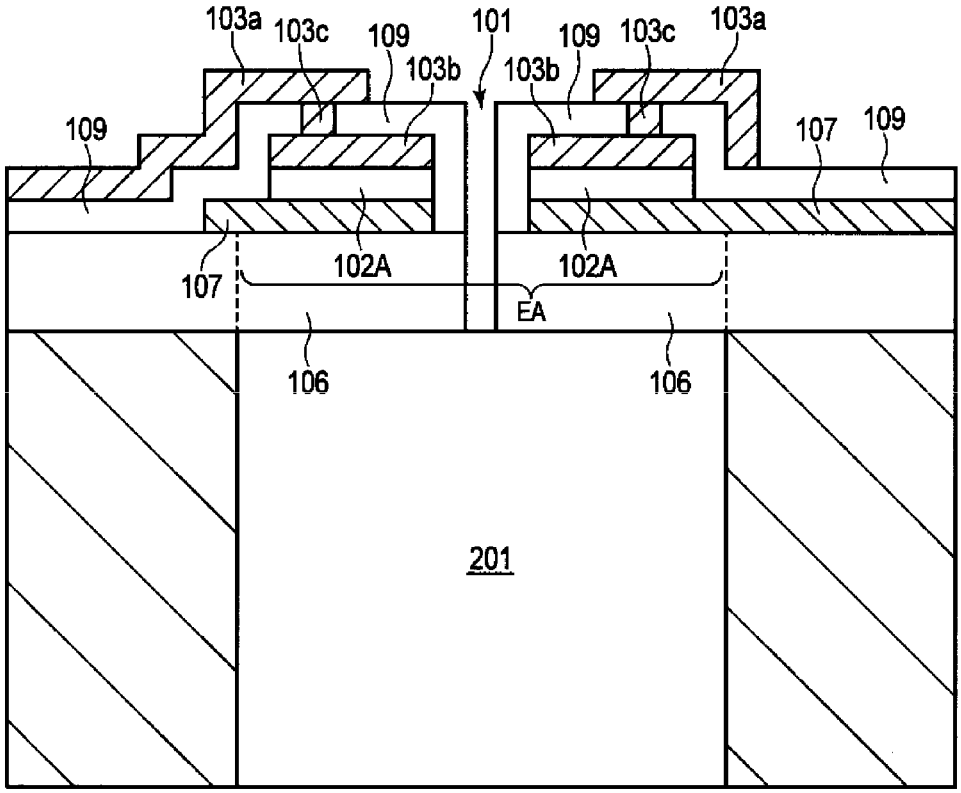
FIG. 4 is a cross-sectional view of the ink jet head provided with the nozzle plate of the first configuration example according to the embodiment.

FIG. 3A is a diagram illustrating a first configuration example of the nozzle plate. FIG. 3A is a plan view of a nozzle plate 100A viewed from ink discharge side. FIG. 4 is a cross-sectional view taken along the line IV-IV in FIG. 3A.

The nozzle plate 100A has the nozzle holes 101 for discharging the ink from the ink pressure chambers 201. In the nozzle plate 100A, an actuator 102A for generating a pressure to discharge the ink from the nozzle hole 101 is configured around the periphery, to encircle the perimeter of, the nozzle hole 101.

Figure 3B:
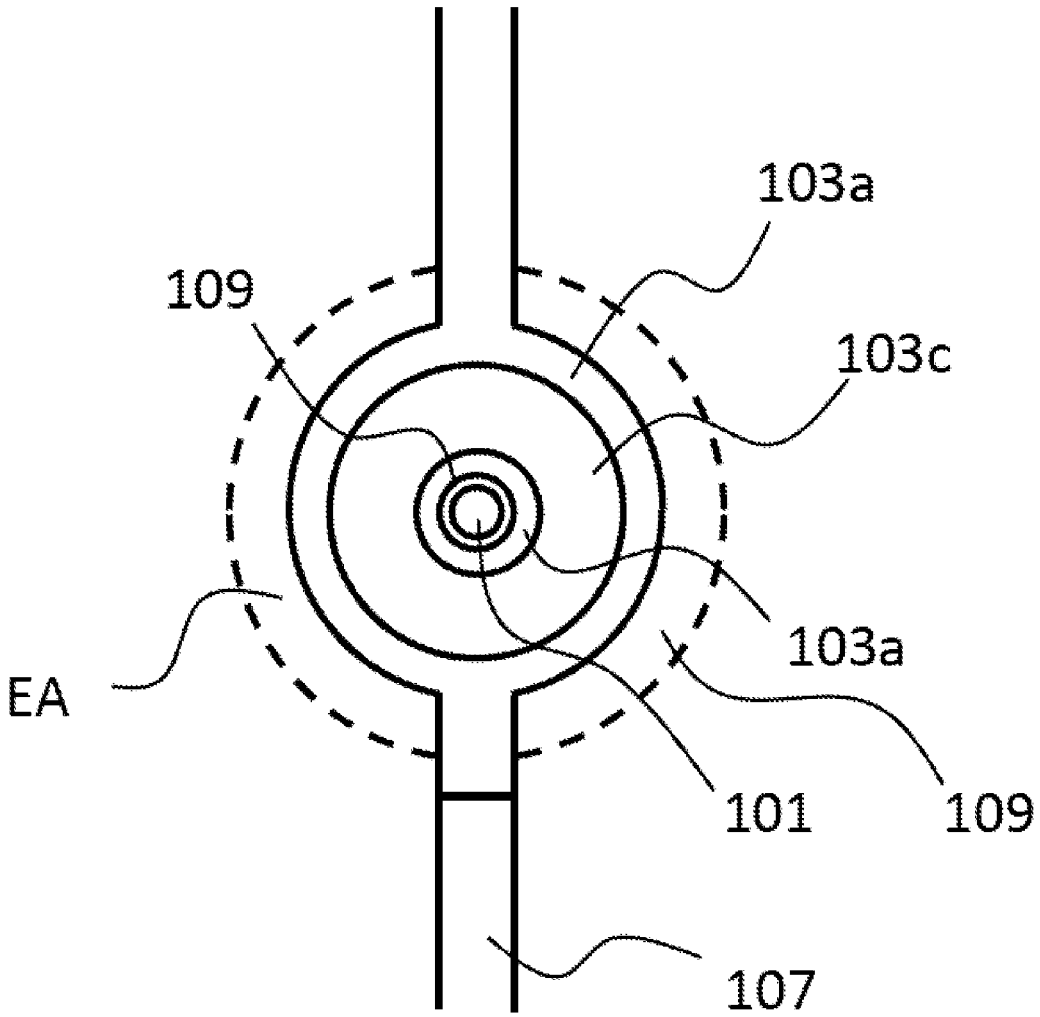
FIG. 3B is a detailed plan view illustrating a structure around a nozzle hole of the nozzle plate according to the embodiment.

The nozzle plate 100A has individual electrodes 103 and common electrodes 107 that transmit a signal for driving the actuators 102A. Moreover, a wiring portion 103*a* of the individual electrode 103 is connected to an individual electrode terminal portion 104 as shown in FIG. 3B. The individual electrode terminal portion 104 is a terminal portion for the individual electrode that receives and carries a signal for driving each nozzle in the ink jet head from the outside of the ink jet head. A common electrode terminal portion 105 is also provided as a terminal portion for the common electrode, which is connected to a wiring portion of the common electrode and it may also receive and carry a signal for driving the ink jet head.

The actuators 102A, the individual electrodes 103, the individual electrode terminal portions 104, the common electrodes 107, the common electrode terminal portions 105, and the insulators 109 are formed on a vibrating plate 106. As illustrated in FIGS. 3A and 4, the actuator 102A, the individual electrode 103, the common electrode 107, and the insulator 109 are configured to be symmetric around the axis of the nozzle hole 101 in a region EA corresponding to the ink pressure chamber 201 on the vibrating plate 106.

In the configuration example illustrated in FIG. 3B, the wiring portion 103*a* of the individual electrode 103 and the wiring portion of the common electrode 107 are disposed to face each other on a straight line, i.e., they are coaxially aligned. Therefore, FIGS. 3A-3B illustrate that the common electrodes 107 and the individual electrodes 103 are symmetrically arranged with respect to each of the nozzle holes 101 in the region EA corresponding to the ink pressure chamber 201. In addition, although FIGS. 3A-3B are a plan view, the common electrodes 107 and the individual electrodes 103 are illustrated, in FIG. 4 to show where the common electrode 107 and the individual electrode 103 overlap where the individual electrode overlies, and is spaced from, the common electrode, and the piezoelectric films are also illustrated in FIG. 4. In addition, FIG. 4 illustrates that in the region EA corresponding to the ink pressure chamber 201 on the vibrating plate 106, the actuator 102A, the individual electrode 103, the common electrode 107, and the insulator layer 109 are formed to be symmetrically disposed with respect to the nozzle hole 101.

The nozzle hole 101 penetrates through the vibrating plate 106 of the nozzle plate 100 and thus extends to the ink pressure chamber 201. For example, in a case where the ink pressure chamber is cylindrical, the center of the circular cross-section of a single ink pressure chamber 201 and the center of the corresponding nozzle hole 101 are configured to be aligned with each other. The ink is supplied to each of the nozzle holes 101 from a corresponding ink pressure chamber 201. The vibrating plate 106 is deformed by an operation of the actuator 102A corresponding to the nozzle hole 101 and discharges the ink supplied to the nozzle hole 101 by a pressure change generated in the ink pressure chamber 201. Each of the nozzle holes 101 has the same action and configuration. In addition, the nozzle hole 101 also has a cylindrical shape. For example, the diameter of the circular cross-section of the nozzle hole is designed to be 20 μm.

The actuator 102A is configured as a piezoelectric film. The piezoelectric film as the actuator 102A is operated by an electric field provided by two electrodes (the individual electrode 103 and the common electrode 107) with the piezoelectric film interposed therebetween. When the piezoelectric film is formed, polarization occurs in the film thickness direction of the piezoelectric film. When an electric field in the same direction as the polarization direction is applied to the piezoelectric film via the electrodes, the actuator 102A extends and contracts in a direction orthogonal to the electric field direction. Using the extension and contraction, the vibrating plate 106 is deformed in the thickness direction of the nozzle plate 100 and generates a pressure change in the ink in the ink pressure chamber 201. In the nozzle plate 100A of the first configuration example, the shape of the piezoelectric film forming each of the actuators 102A is circular (annular). In this case, the piezoelectric film as the actuator 102A is concentric with the discharge side opening of the nozzle hole 101. That is, the piezoelectric film is formed to surround the discharge side opening of the nozzle hole 101. The diameter of the circular piezoelectric film is, for example, 170 μm.

In the nozzle plate 100A illustrated in FIG. 3A, in order to arrange the nozzle holes 101 at a high density, the plurality of actuators 102A disposed around the respective nozzle holes 101 are arranged in a zigzag pattern (alternately). In the configuration example illustrated in FIG. 3A, the plurality of nozzle holes 101 and the actuators 102A disposed around the respective nozzle holes 101 are arranged to extend in the X-axis direction as illustrated in FIG. 3A. In addition, the plurality of nozzle holes 101 and the actuators 102A disposed around the respective nozzle holes 101 are lined up in two rows in a straight line pattern and the straight lines extending thorough the center of alternate nozzle holes are spaced apart in the Y-axis direction. The distance between the centers of the nozzle holes 101 adjacent in the X-axis direction is designed to be, for example, 340 μm. In this case, the arrangement interval between the two rows of the nozzle holes 101 in the Y-axis direction is designed to be 240 μm. In this arrangement, alternate individual electrodes 103 may extend between adjacent two actuators 102A in the X-axis direction.

As the material of the piezoelectric film, for example, PZT (lead zirconium titanate) is used. As other materials of the piezoelectric film, PTO ($PbTiO_3$: lead titanate) PMNT ($Pb(Mg_{1/3}Nb_{2/3})O_3$—$PbTiO_3$), PZNT ($Pb(Zn_{1/3}Nb_{2/3})O_3$—$PbTiO_3$), ZnO, AlN, and the like can also be used.

The piezoelectric film is formed at a substrate temperature of 350° C. by, for example, an RF magnetron sputtering method. The film thickness is designed to be, for example, 1 μm. After forming the piezoelectric film, in order to impart piezoelectric properties on the piezoelectric film, for example, the piezoelectric film is subjected to a heat treatment at 500° C. for 3 hours. Accordingly, good piezoelectric performance can be obtained. As other methods of producing the piezoelectric film, CVD (chemical vapor deposition method), sol-gel method, AD method (aerosol deposition method), hydrothermal synthesis method, or the like can also be used. In addition, the thickness of the piezoelectric film is determined by piezoelectric characteristics, a dielectric breakdown voltage, and the like. The thickness of the piezoelectric film is substantially in a range of 0.1 μm to 5 μm.

Each of the individual electrodes 103 is a first electrode and is one electrode of the two electrodes connected to the piezoelectric film of the corresponding actuator 102A. Each of the individual electrodes 103 functions as an individual electrode for independently operating the piezoelectric film as an actuator. Each of the individual electrodes 103 has an upper electrode (individual electrode film) 103*b* formed on the piezoelectric film (discharge side) of the corresponding actuator 102A. That is, each of the upper electrodes 103*b* is formed to individually come into contact with the discharge side for each piezoelectric film. The upper electrode 103*b* is connected to the wiring portion 103*a* of the individual electrode 103 via a connection portion 103*c*.

That is, each of the individual electrodes 103 is constituted by the wiring portion 103*a* connected to the individual electrode terminal portion 104, the upper electrode 103*b* that comes into contact with the piezoelectric film, and the connection portion 103*c* that electrically connects the wiring portion 103*a* and the upper electrode 103*b*. Since the nozzle hole 101 is formed at the center of the circular electrode arranged around the nozzle hole 101, for example, the upper electrode 103*b* has a portion with no electrode film in a shape concentric with the nozzle hole 101.

The individual electrode 103 is formed of, for example, a Pt (platinum) thin film. The thin film is formed to have a film thickness of 0.5 μm musing a sputtering method. As other electrode materials of the individual electrode 103, Ni (nickel), Cu (copper), Al (aluminum), Ti (titanium), W (tantalum), Mo (molybdenum), Au (gold), and the like can also be used. In addition, as other film formation methods of the upper electrode 103*b*, deposition or plating can also be used. For example, the film thickness of the upper electrode 103*b* of each of the individual electrodes 103 is about 0.01 to 1 μm.

The common electrode 107 is the second electrode and is the other electrode of the two electrodes, which is connected to the piezoelectric film at and underlying the actuator 102A. The common electrode 107 is formed on the ink pressure chamber 201 side from the piezoelectric film 102A. The common electrode 107 is a shared bus connected to each of the piezoelectric films acting as the actuators 102A and functions as a common electrode. The common electrode 107 has a configuration in which the electrode part (the common electrode film) that comes into contact with the piezoelectric film is disposed on the opposite side of the individual electrode wiring portion with respect to the actuator 102A and it extends to both ends, in the X-axis direction, of the nozzle plate 100A and is also connected to the common electrode terminal portion 105. Since the nozzle hole 101 is formed at the center of the circular electrode part that comes into contact with the piezoelectric film 102A, similarly to the upper electrode of the individual electrode, there is a part with no common electrode film in a shape concentric with the nozzle hole 101.

The common electrode 107 is formed of, for example, a Pt (platinum)/Ti (titanium) thin film. The thin film is formed to have a film thickness of 0.5 μm using a sputtering method. As other electrode materials of the common electrode 107, Ni, Cu, Al, Ti, W, Mo, Au, and the like can also be used. As other film formation methods, deposition or plating can also be used. The film thickness of common electrode 107 is, for example, about 0.01 to 1 μm.

The individual electrode terminal portion 104 and the common electrode terminal portion 105 are provided to receive a signal for driving the actuators 102A from an external driving circuit. The individual electrode 103 and the common electrode 107 are wired to connect across the actuators 102A. The individual electrode 103 and the common electrode 107 have a wiring width of, for example, about 80 μm.

The interval between the individual electrode terminal portions 104 has a size based on an interval of 340 μm in the X-axis direction between the nozzle holes 101, and thus the width in the X-axis direction of the individual electrode terminal portion 104 can be increased compared to the wiring width of the individual electrode 103. In this configuration, connection between the external driving circuit and each of the individual electrode terminal portions 104 is easily achieved. Each of the individual electrodes 103 individually drives the corresponding actuator 102A.

In addition, the individual electrode 103 and the common electrode 107 may be symmetrically disposed with respect to the nozzle hole 101 in the region EA of the ink pressure chamber 201 on the vibrating plate 106. For example, in the configuration example illustrated in FIG. 3A, the electric wire portion of the individual electrode 103 and the electric wire portion of the common electrode 107 are disposed to face each other on a straight line, i.e., to be aligned coaxially, and the electric wire portion of the individual electrode 103 and the electric wire portion of the common electrode 107 are configured to be axially symmetrical with respect to the corresponding nozzle hole 101.

As described above, in the nozzle plate 100A of the first configuration example illustrated in FIGS. 3 and 4, the electric wire portion of the individual electrode 103 and the electric wire portion of the common electrode 107 are arranged on a straight line that passes through the nozzle hole 101 and are arranged to be axially symmetrical with respect to the nozzle hole 101 at least in the region EA. Accordingly, in the nozzle plate 100A of the first configuration example illustrated in FIGS. 3 and 4, the operation of the actuator 102A is also axially symmetrical with respect to the nozzle hole 101, and thus the ink discharge direction from the nozzle hole 101 is stabilized. As a result, the ink jet head to which the nozzle plate 100A of the first configuration example is applied can realize image formation with a good printing quality.

Next, a modification example of the nozzle plate 100A of the first configuration example will be described.

Figure 5:
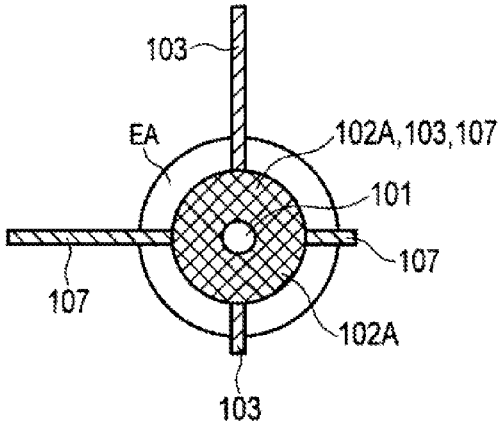
FIG. 5 is a diagram illustrating a modification example of an individual electrode and a common electrode in the nozzle plate of the first configuration example according to the embodiment.

FIG. 5 illustrates another configuration example (modification example) of the individual electrode 103 and the common electrode 107 for the circular actuator 102A disposed in the nozzle plate 100A of the first configuration example. In the configuration example illustrated in FIG. 5, the electric wire portion of the individual electrode 103 and the electric wire portion of the common electrode 107 are arranged to be orthogonal to each other with respect to the nozzle hole 101. Even in the configuration illustrated in FIG. 5, the individual electrode 103 and the common electrode 107 are axially symmetrical with respect to the nozzle hole 101 in the region EA of the ink pressure chamber 201 on the vibrating plate 106.

Accordingly, even when the nozzle plate 100A of the first configuration example has the configuration illustrated in FIG. 5, the operation of the actuator 102A is axially symmetric with respect to the nozzle hole 101, and thus the ink discharge direction from the nozzle hole 101 is reliably predictable. As a result, in the ink jet head to which the nozzle plate 100A of the first configuration example having the configuration illustrated in FIG. 5 is applied, since the ink discharge direction from the nozzle hole is reliably predictable, image formation with a good printing quality can be realized.

Next, a second configuration example of the nozzle plate will be described.

Figure 6:
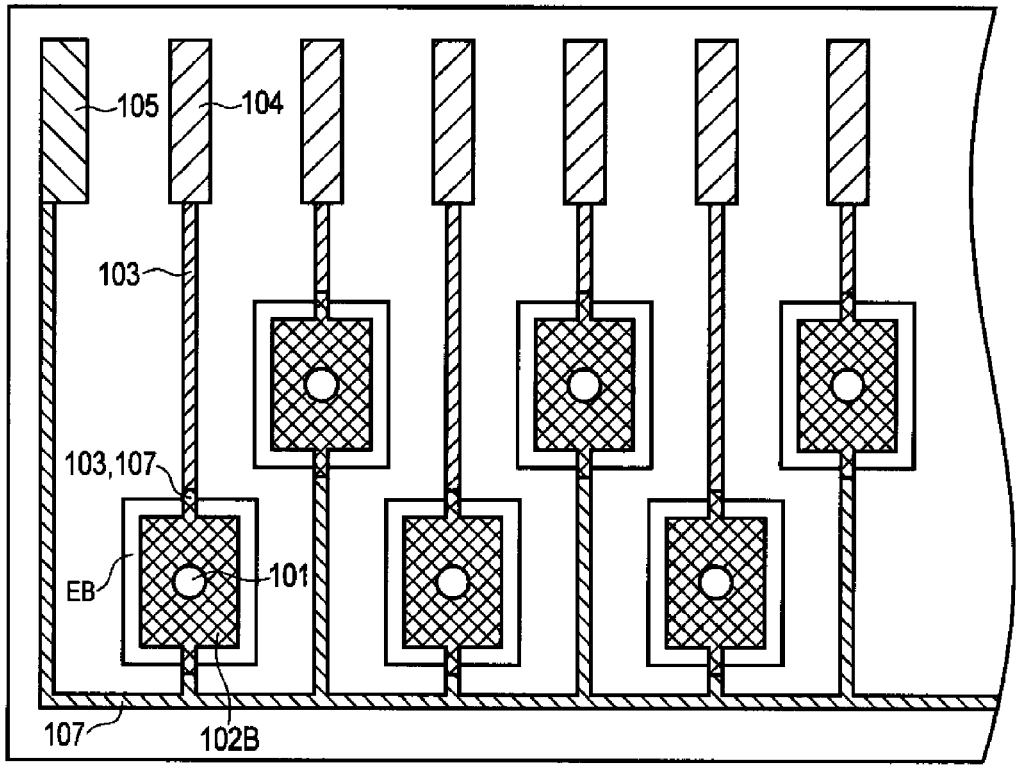
FIG. 6 is a plan view illustrating a second configuration example of the nozzle plate according to the embodiment.

FIG. 6 is a diagram illustrating a nozzle plate 100B of the second configuration example.

The nozzle plate 100B of the second configuration example illustrated in FIG. 6 is different from the nozzle plate 100A of the first configuration example illustrated in FIG. 3A in the shape of the actuator and the like. That is, the nozzle plate 100B illustrated in FIG. 6 is a configuration example in which the ink pressure chamber 201 has a rectangular cross-section, and an actuator 102B for each nozzle is annularly rectangular. In addition, since the second configuration example is the same as the first configuration example except for the shapes of the actuator 102B and the ink pressure chamber, detailed description thereof will be omitted.

A piezoelectric film as the actuator 102B has a rectangular shape. The actuator 102B has, for example, a rectangular shape with a width of 170 μm and a length of 340 μm. The shape of the ink pressure chamber 201 is also rectangular according to the shape of the piezoelectric film as the actuator 102B, and a region EB of the ink pressure chamber on the vibrating plate 106 is also a rectangular region. In addition, the nozzle hole 101 is designed to have, for example, a diameter of 20 μm and is provided at the center of the region EB of the ink pressure chamber (for example, at a position having the intersection of the diagonal lines of the rectangular region EB as the center).

In the nozzle plate 100B of the second configuration example illustrated in FIG. 6, the electric wire portion of the individual electrode 103 and the electric wire portion of the common electrode 107 are arranged on a straight line that passes through the nozzle hole 101 and are arranged to be axially symmetrical with respect to the nozzle hole 101 at least in the region EB. Accordingly, in the nozzle plate 100B of the second configuration example illustrated in FIG. 6, the operation of the actuator 102B is axially symmetrical with respect to the nozzle hole 101, and thus the ink discharge direction from the nozzle hole 101 is reliably predictable. That is, the ink comes out collinearly with the hole axis without side spray. As a result, the ink jet head to which the nozzle plate 100B of the second configuration example is applied can realize image formation with a good printing quality.

In addition, in the nozzle plate 100B of the second configuration example illustrated in FIG. 6, the actuator 102B is reduced in size to 170 μm in the width direction compared to the nozzle plate 100A of the first configuration example having the circular actuator (piezoelectric film). That is, in the nozzle plate 100B of the second configuration example, the interval through which the individual electrode 103 passes is widened compared to the nozzle plate 100A of the first configuration example, and thus the spacing between the individual electrode 103 can be increased, resulting in enhancement in electric reliability.

Next, a modification example of the nozzle plate 100B of the second configuration example will be described.

Figure 7A:
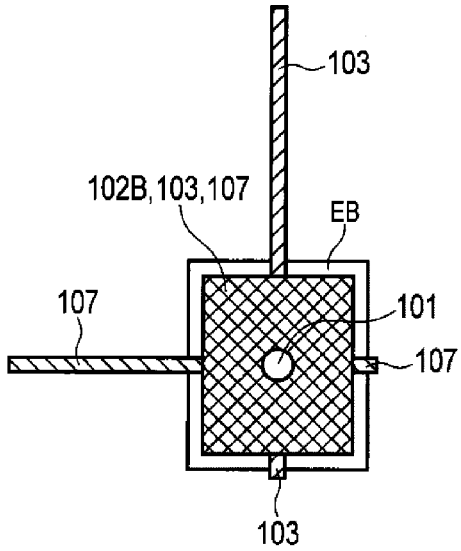
FIGS. 7A and 7B are diagrams illustrating modification examples of the individual electrode and the common electrode in the nozzle plate of the second configuration example according to the embodiment.
Figure 7B:
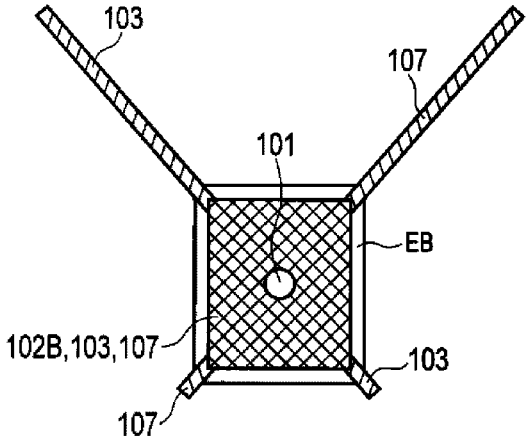

FIGS. 7A and 7B are diagrams illustrating different patterns (modification examples) from that of the individual electrode 103 and the common electrode 107 for the rectangular actuator 102B arranged in the nozzle plate 100B of the second configuration example.

In the configuration example illustrated in FIG. 7A, the electric wire portion of the individual electrode 103 and the electric wire portion of the common electrode 107 are arranged to be orthogonal to each other with respect to the nozzle hole 101. That is, the electric wire portion of the individual electrode 103 is disposed on a straight line that passes through the nozzle hole 101 and the middle point of the long side of the rectangular actuator 102B, and the electric wire portion of the common electrode 107 is disposed on a straight line that passes through the nozzle hole 101 and the middle point of the short side of the rectangular actuator 102B. Moreover, the electric wire portion of the individual electrode 103 and the electric wire portion of the common electrode 107 are arranged to be axially symmetric with respect to the nozzle hole 101 at least in the region EB.

In addition, in the configuration example illustrated in FIG. 7B, the electric wire portion of the individual electrode 103 and the electric wire portion of the common electrode 107 are arranged to be orthogonal to each other with respect to the nozzle hole 101. That is, the electric wire portion of the individual electrode 103 is disposed on a straight line that passes through the nozzle hole 101 and one diagonal line of the rectangular actuator 102B, and the electric wire portion of the common electrode 107 is disposed on a straight line that passes through the nozzle hole 101 and the other diagonal line of the rectangular actuator 102B. Moreover, the electric wire portion of the individual electrode 103 and the electric wire portion of the common electrode 107 are arranged to be axially symmetrical with respect to the nozzle hole 101 at least in the region EB.

In the configurations illustrated in FIGS. 7A and 7B, the individual electrode 103 and the common electrode 107 are arranged to be axially symmetrical with respect to the nozzle hole 101 in the region EB of the ink pressure chamber 201 on the vibrating plate 106. Accordingly, even when the nozzle plate 100B of the second configuration example has the configurations illustrated in FIGS. 7A and 7B, the operation of the actuator 102B is axially symmetrical with respect to the nozzle hole 101, and thus the ink discharge direction from the nozzle hole 101 is stabilized. As a result, in the ink jet head to which the nozzle plate 100B of the second configuration example having the configurations illustrated in FIGS. 7A and 7B is applied, since the ink discharge direction from the nozzle hole is stabilized, and image formation with a good printing quality can be realized.

Next, a third configuration example of the nozzle plate will be described.

Figure 8:
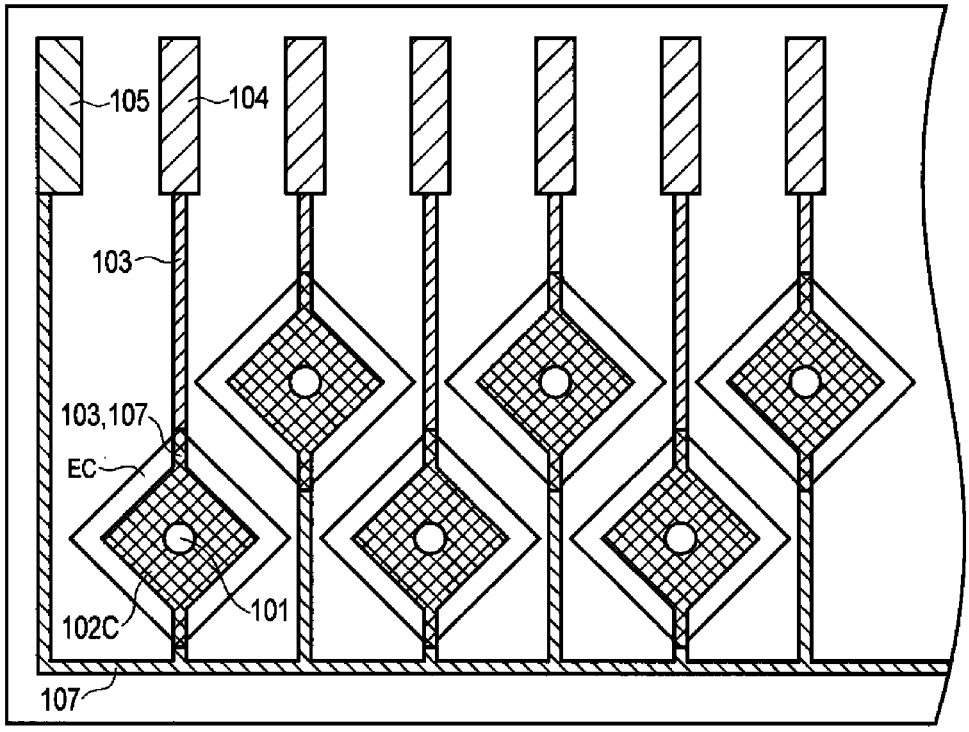
FIG. 8 is a plan view illustrating a third configuration example of the nozzle plate according to the embodiment.

FIG. 8 is a diagram illustrating a nozzle plate 100C of the third configuration example.

The nozzle plate 100C of the third configuration example illustrated in FIG. 8 is different from the nozzle plate 100A of the first configuration example illustrated in FIG. 3A in the shape of the actuator and the like. The nozzle plate 100C illustrated in FIG. 8 is a configuration example in which the ink pressure chamber 201 has a rhombic cross-section, and an actuator 102C for each nozzle has a rhombic shape. In addition, since the nozzle plate 100C of the third configuration example can be realized to be same as the first configuration example except for the shapes of the actuator 102C and the ink pressure chamber, detailed description thereof will be omitted.

The actuator 102C has, for example, a rhombic shape with a width of 300 μm and a length of 300 μm. The shape of the ink pressure chamber 201 is also rhombic according to the shape of the piezoelectric film as the actuator 102C, and a region EC of the ink pressure chamber on the vibrating plate 106 is also a rhombic region. In addition, the nozzle hole 101 is designed to have, for example, a diameter of 20 μm and is provided at the center of the region EC of the ink pressure chamber (for example, at a position having the intersection of the diagonal lines of the rhombic region EC as the center).

In the nozzle plate 100C of the third configuration example illustrated in FIG. 8, the electric wire portion of the individual electrode 103 and the electric wire portion of the common electrode 107 are arranged on a straight line that passes through the nozzle hole 101 and are arranged to be axially symmetric with respect to the nozzle hole 101 at least in the region EC. Accordingly, in the nozzle plate 100C of the third configuration example illustrated in FIG. 8, the operation of the actuator 102C is also axially symmetric with respect to the nozzle hole 101, and thus the ink discharge direction from the nozzle hole 101 is reliably predictable. As a result, the ink jet head to which the nozzle plate 100C of the third configuration example is applied can realize image formation with a good printing quality.

In addition, in the nozzle plate 100C of the third configuration example illustrated in FIG. 8, the actuators 102C as the respective nozzles can be arranged at a high density compared to the nozzle plate 100A of the first configuration example having the circular actuator (piezoelectric film). That is, in the nozzle plate 100C of the third configuration example, since the actuators 102C can be arranged at a high density compared to the nozzle plate 100A of the first configuration example, the ink jet head in which the nozzles that discharge ink are arranged at a high density can be realized.

Next, a modification example of the nozzle plate 100C of the third configuration example will be described.

Figure 9A:
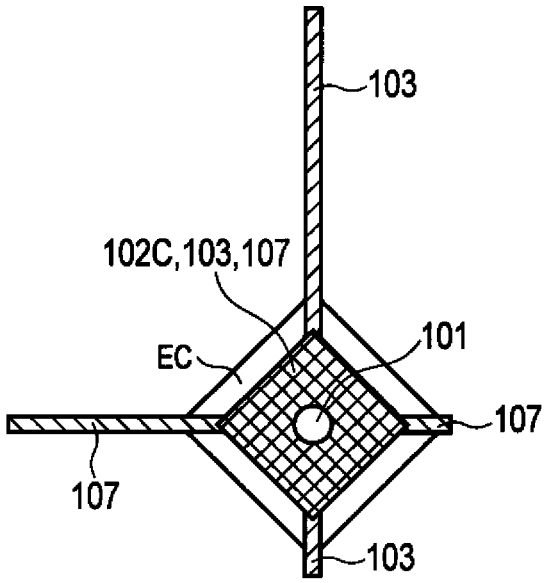
FIGS. 9A and 9B are diagrams illustrating modification examples of the individual electrode and the common electrode in the nozzle plate of the third configuration example according to the embodiment.
Figure 9B:
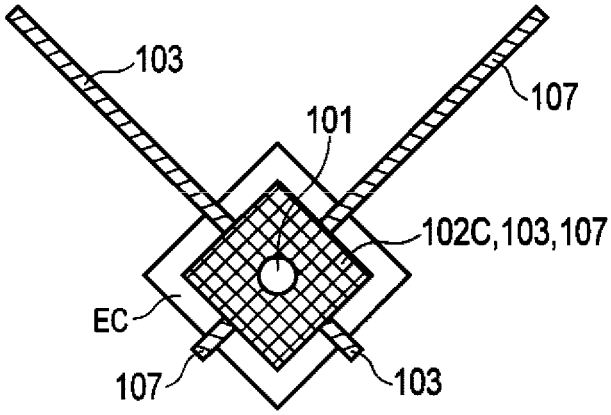

FIGS. 9A and 9B are diagrams illustrating different patterns (modification examples) from that of the individual electrode 103 and the common electrode 107 for the rhombic actuator 102C arranged in the nozzle plate 100C of the third configuration example.

In the configuration example illustrated in FIG. 9A, the electric wire portion of the individual electrode 103 and the electric wire portion of the common electrode 107 are arranged to be orthogonal to each other with respect to the nozzle hole 101. That is, the electric wire portion of the individual electrode 103 is disposed on a straight line that passes through the nozzle hole 101 and one diagonal line of the rhombic actuator 102C, and the electric wire portion of the common electrode 107 is disposed on a straight line that passes through the nozzle hole 101 and the other diagonal line of the rhombic actuator 102C. Moreover, the electric wire portion of the individual electrode 103 and the electric wire portion of the common electrode 107 are arranged to be axially symmetrical with respect to the nozzle hole 101 at least in the region EC.

In addition, in the configuration example illustrated in FIG. 9B, the electric wire portion of the individual electrode 103 and the electric wire portion of the common electrode 107 are arranged on straight lines to intersect each other at the nozzle hole 101. That is, the electric wire portion of the individual electrode 103 is disposed on the straight line that passes through the nozzle hole 101 and the middle point of two opposing sides in the rhombic actuator 102C, and the electric wire portion of the common electrode 107 is disposed on the straight line that passes through the nozzle hole 101 and the middle point of the other two sides in the rhombic actuator 102C. Moreover, the electric wire portion of the individual electrode 103 and the electric wire portion of the common electrode 107 are arranged to be axially symmetrical with respect to the nozzle hole 101 at least in the region EC.

In the configurations illustrated in FIGS. 9A and 9B, the individual electrode 103 and the common electrode 107 are arranged to be axially symmetrical with respect to the nozzle hole 101 in the region EC on the ink pressure chamber 201 on the vibrating plate 106. That is, even when the nozzle plate 100C of the third configuration example has the configurations illustrated in FIGS. 9A and 9B, the operation of the actuator 102C is axially symmetric, and thus the ink discharge direction from the nozzle hole 101 is reliably predictable. As a result, in the ink jet head to which the nozzle plate 100C of the third configuration example having the configurations illustrated in FIGS. 9A and 9B is applied, since the ink discharge direction from each nozzle hole is reliably predictable, image formation with a good printing quality can be realized.

As described above, the ink jet head according to this embodiment has the nozzle hole that discharges the ink supplied from the ink pressure chamber by the deformation of the actuator, and forms the electrodes to have axially symmetric shapes with respect to the nozzle hole at least in the region corresponding to the ink pressure chamber. Accordingly, according to the ink jet head according to this embodiment, the operation of the actuator is axially symmetric with respect to the nozzle hole. As a result, the ink discharge direction is stabilized, occurrence of misdirection can be prevented, and thus printing quality can be enhanced.

In the above embodiments, the electrode formed on the ink pressure chamber 201 side with respect to the piezoelectric film 102A is the common electrode and the electrode formed on the opposite side to the ink pressure chamber 201 with respect to the piezoelectric film 102A is the individual electrode. However, the electrode formed on the ink pressure chamber 201 side with respect to the piezoelectric film 102A may also be the individual electrode and the electrode formed on the opposite side to the ink pressure chamber 201 with respect to the piezoelectric film 102A may also be the common electrode.

While certain embodiments have been described, these embodiments have been presented by way of example only, and are not intended to limit the scope of the inventions. Indeed, the novel embodiments described herein may be embodied in a variety of other forms; furthermore, various omissions, substitutions and changes in the form of the embodiments described herein maybe made without departing from the spirit of the inventions. The accompanying claims and their equivalents are intended to cover such forms or modifications as would fall within the scope and spirit of the inventions.

What is claimed is:

1. An ink jet head comprising:

an ink pressure chamber configured to store ink;

a nozzle hole through which the ink in the ink pressure chamber is discharged;

a vibrating plate formed over the ink pressure chamber to surround the nozzle hole;

an actuator to drive the vibrating plate; and electrodes formed to drive the actuator, the electrodes comprising a first electrode and a second electrode with the actuator interposed therebetween;

wherein the second electrode is formed on the vibrating plate and in contact with a first surface of the actuator;

wherein the first electrode comprises an upper electrode in contact with a second surface of the actuator opposite the first surface, a connection portion in contact with the upper electrode, and a wiring portion in contact with the connection portion; and wherein the first electrode and the second electrode are symmetrically disposed around the nozzle hole in a region on the vibrating plate corresponding to the ink pressure chamber.

2. The ink jet head according to claim 1, further comprising:

an insulating film that insulates the first electrode and the second electrode from one another, wherein the first electrode, the second electrode, the actuator, and the insulating film are formed to be axially symmetric with respect to the nozzle hole in the region.

3. The ink jet head according to claim 1, further comprising:

an ink pressure chamber structure which includes a plurality of the ink pressure chambers; and a plate which includes a plurality of nozzles provided with the nozzle hole, the actuator, and the electrodes to oppose the respective ink pressure chambers.

4. The ink jet head of claim 1, wherein the ink pressure change has a circumferential profile, and the axially symmetric electrodes have the same profile.

5. The ink jet head of claim 4, wherein the area of the profile of the ink pressure chamber and electrodes are the same.

6. The ink jet head of claim 4, wherein the profile is rectangular.

7. The ink jet head of claim 4, where the profile is rhombic.

8. The ink jet head of claim 1, wherein the wiring portion of the first electrode and a wiring portion of the second electrode are collinearly aligned within a plane of the vibrating plate along an axis passing through the nozzle hole.

9. The ink jet head of claim 1, wherein the wiring portion of the first electrode and a wiring portion of the second electrode are perpendicularly aligned within a plane of the vibrating plate along perpendicular axes passing through the nozzle hole.

* * * * *